United States Patent [19]

Limque et al.

[11] 4,278,421

[45] Jul. 14, 1981

[54] INDUSTRIAL FURNACES FOR THE HEAT TREATMENT OF METALLIC WORKPIECES

[75] Inventors: Ferdinand Limque, Berg en Dal, Netherlands; Hans Bertrand, Goch, Fed. Rep. of Germany

[73] Assignee: Ipsen Industries International Gesellschaft mit beschränkter Haftung, Kleve, Fed. Rep. of Germany

[21] Appl. No.: 85,083

[22] Filed: Oct. 15, 1979

[30] Foreign Application Priority Data

Oct. 14, 1978 [DE] Fed. Rep. of Germany ..... 2844843

[51] Int. Cl.[3] ..... F27B 9/04

[52] U.S. Cl. ..... 432/152; 98/40 E; 266/251; 266/259; 432/144; 432/199; 432/203

[58] Field of Search ..... 432/144, 152, 198, 199, 432/203, 205; 98/40 E; 266/251, 259

[56] References Cited

U.S. PATENT DOCUMENTS

| | | | |
|---|---|---|---|
| 2,471,775 | 5/1949 | Reece | 98/40 E |
| 3,301,541 | 1/1967 | Ipsen | 432/205 |
| 3,677,166 | 7/1972 | Sisk, Jr. et al. | 415/125 |
| 4,007,673 | 2/1977 | Zaloga | 98/94 R |
| 4,162,141 | 7/1979 | West | 432/144 |

*Primary Examiner*—John J. Camby

*Attorney, Agent, or Firm*—Martin A. Farber

[57] ABSTRACT

An industrial furnace, particularly a single-chamber vacuum furnace, for the heat treatment of metallic workpieces, with a heating chamber which is formed in a housing, which heating chamber is heatable via heating elements and is provided on the bottom and on the ceiling with a closable chamber opening for the passage of a quenching gas which can be circulated by means of a blower. A flap is swingably mounted at the chamber opening underneath a closing slide, which chamber opening is provided for the entrance of the gas. The flap controls the incoming flow of gas within the range of the free cross-section of the chamber opening.

12 Claims, 3 Drawing Figures

INDUSTRIAL FURNACES FOR THE HEAT TREATMENT OF METALLIC WORKPIECES

This invention relates to an industrial furnace, particularly a single-chamber vacuum furnace, for the heat treatment of metallic workpieces, which has a heating chamber which is developed in a housing and can be heated via heating elements and is provided on the bottom and on the roof with a closable chamber opening for the passage of a quenching gas which can be circulated by means of a blower.

Industrial furnaces of this type are already known. They are used in particular in order to be able rapidly to harden parts made of high speed steels and other tool steels. However, they are also suitable for other heating treatments, for instance for bright annealing. Such a furnace consists of a double-walled steel housing having an openable front door which permits access to the heating chamber. The heating chamber is formed of a steel shell which is lined with heat insulation. The heating chamber is provided both at its bottom and on its roof with a large gas passage opening. These openings are closed by insulated closure slides during the heating and holding periods. The upper gas passage opening of the heating chamber is connected directly via a pipe connection with the discharge outlet of a blower. This has the disadvantage that the stream of gas flowing through the pipe connection into the heating chamber is able only to pass over a comparably small charge. An increase in the size of the charge is prevented by the reduction in the rate of cooling which results therefrom. It is also not possible to increase the diameter of the discharge outlet of the blower since, for the same blower output this would mean a loss in speed. A high speed of the gas is, however, necessary in order to achieve a rapid cooling of the charge. Only with a sufficiently rapid removal of heat is it possible to carry out, for instance, a hardening. Therefore, in order to obtain a rapid cooling of the charge it is necessary that the quenching gas blown into the heating chamber be circulated with high speed. For a given output of the blower the speed of the gas is dependent on the diameter of the pipe connection, but the diameter of the pipe in its turn is controlling with respect to the size of the surface of the charge which is passed over by the quenching gas, with the result that in actual practice the output of the furnace is necessarily limited for a given quality of the heat treated workpieces.

The object of the present invention is to increase the furnace output of an industrial furnace of the aforementioned type. A larger surface of the charge is to be capable of being subjected to rapid cooling and the existing furnace space thus utilized better.

This object is achieved in accordance with the invention in the manner that a flap is swingably supported at the chamber opening intended for the entrance of the gas, this flap controlling the incoming stream of gas within the region of the free cross-section of the chamber opening. By swinging the flap it is possible so to deflect the gas during the cooling period that the entire charge is passed over by it even if the charge substantially completely fills the heating chamber. A larger surface of the charge than in the prior art can, accordingly, be rapidly cooled. The flap is in this connection either moved continuously or held in individual positions for specific periods of time. The direction of the stream of gas fed is thus continually varied and is not limited merely to the central region which lies below the chamber opening intended for the admission of the gas.

In order to improve the deflecting action of the surface of the flap on the stream of gas it is advisable to arrange the flap in the path of flow of the gas directly in front of the chamber opening. The hinge axis of the flap advantageously extends parallel to the cross sectional plane of the chamber opening and preferably centrally to the chamber opening.

In order to be able to effect a complete change in direction of the stream of gas fed, the flap can assume at least one end position in which it closes off one region of the free cross section of the chamber opening. In this case, in its end position the flap preferably forms an angle of about 45° with the cross sectional plane of the chamber opening. The total path of movement of the flap then covers an angle of 90°.

Instead of a single flap, a double flap in a parallelogram arrangement can also be used. Whatever the development of the flap it is, however, advantageous for the flap to be so arranged that its swinging movement from its one end position into its other end position takes place against the direction of the flow of the gas. Otherwise greater force must be expended in order to effect the closing of the flap and to hold the flap tight on its flap seat when in its end position.

In accordance with a preferred embodiment of the furnace of the invention the flap is mounted with its hinge axis directly above the closing slide which is provided in order to close the chamber opening intended for the admission of the gas. The flap extends upwards, in direction opposite the direction of the stream of gas, at an angle of 45° in its extreme positions. These positions are developed within a funnel-shaped hood the widened funnel portion of which is fastened on the top of the furnace housing and the narrow pipe portion of which is connected to the discharge outlet of the blower.

By the flap control high speeds of the gas are obtained which afford the possibility in novel fashion on single-chamber vacuum furnaces of providing a heat exchanger and a blower one behind the other in the axial direction within the furnace housing. A sufficient rate of cooling is obtained with the flap of the invention even in the case of a quenching gas of higher temperature and accordingly lesser density. When the heating chamber, heat exchanger and blower are arranged axially one behind the other within the furnace housing it is advantageous to arrange the blower motor in a hood of the furnace which is attached to its end by flanging. The connection between the blower outlet and the gas inlet takes place through a tube arranged on the outside.

A larger surface of charge can be passed over by the quenching gas with the furnace of the invention and the existing furnace space can thus be fully utilized. Uniform hardening results are obtained in a very short time by the high gas speed made possible. The construction is simple, compact and low in losses with respect to the velocity of flow obtainable. Thus it is possible with the furnace of the invention to harden even workpieces of larger cross section, for instance high-speed steel drills of a diameter of 50 mm instead of 10 mm.

Further details, features, and advantages of the object of the invention will become evident from the description of the accompanying drawing in which a preferred embodiment of a furnace in accordance with the invention has been diagrammatically shown.

Figure 1:
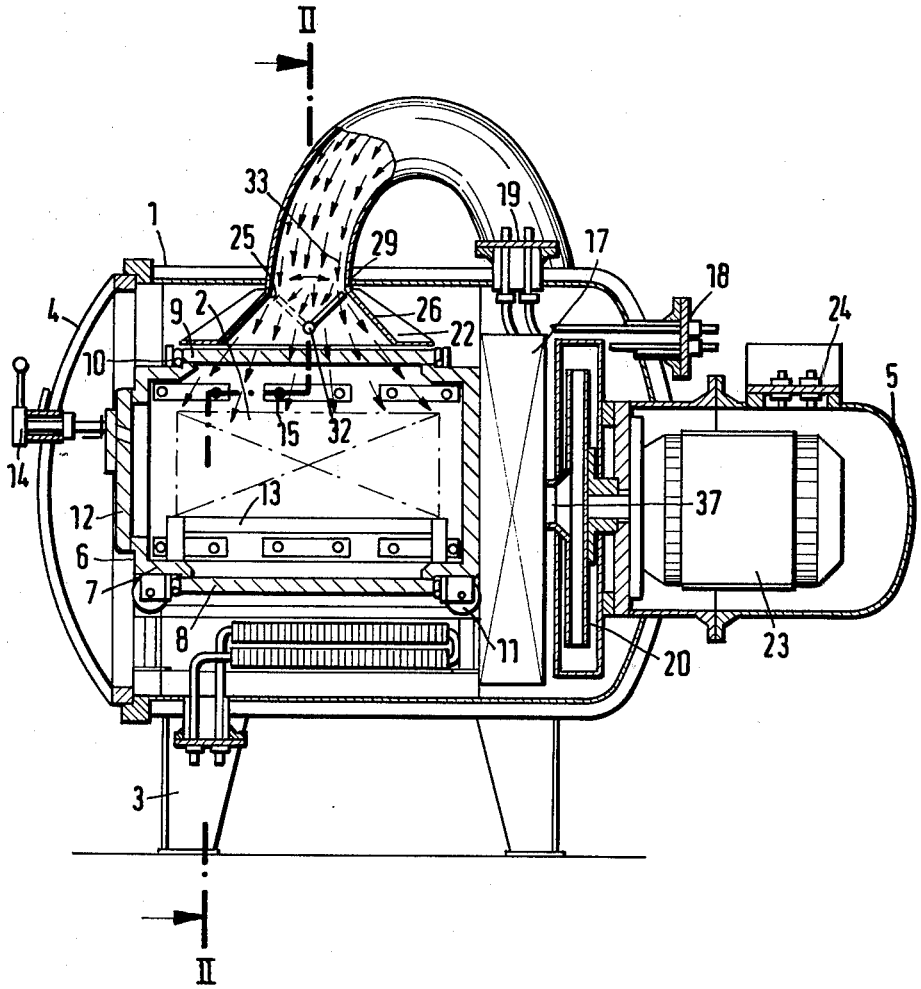
FIG. 1 is a longitudinal section through a single-chamber vacuum furnace with pressure-gas quenching gas device.

The single-chamber vacuum furnace with pressure-gas quenching device consists essentially of a double-walled steel housing 1 within which a heating chamber 2 is arranged. The furnace housing 1 is cylindrical and stands on legs 3 which are welded to its bottom. At its front end, the furnace housing (on the left side of the drawing) is provided with a downwardly swingable front door 4 which is also developed with a double wall. The opposite end (to the right in the drawing) of the furnace housing 1 bears centrally a circular recess into which there is inserted a hood 5 which serves to receive a motor, described further below.

The heating chamber 2 is formed of a steel shell 6 which is lined with a self-supporting graphite insulation 7. The heating chamber 2 is provided with a large gas-passage opening both at its bottom and on its roof. These openings are closed by insulated closing slides 8, 9 during the heating and holding periods. The opening and closing are effected pneumatically by means of piston/cylinder units (not shown). For this purpose the closing slides 8 and 9 are mounted in guides 10. The heating chamber 2 is mounted on wheels 11 so that it can be removed from the furnace in order to facilitate maintenance work.

On its front side the heating chamber 2 is closed by a downwardly swingable insulated door 12 through which a charge can be introduced into the furnace in the form of a basket (indicated in dashed line within the heating chamber in the drawing). For the treatment of the charge it is seated on a charge table 13. The inside of the heating chamber can be observed through a viewing glass in the door 12, which glass can be exposed from the outside via a mechanism 14.

Figure 2:
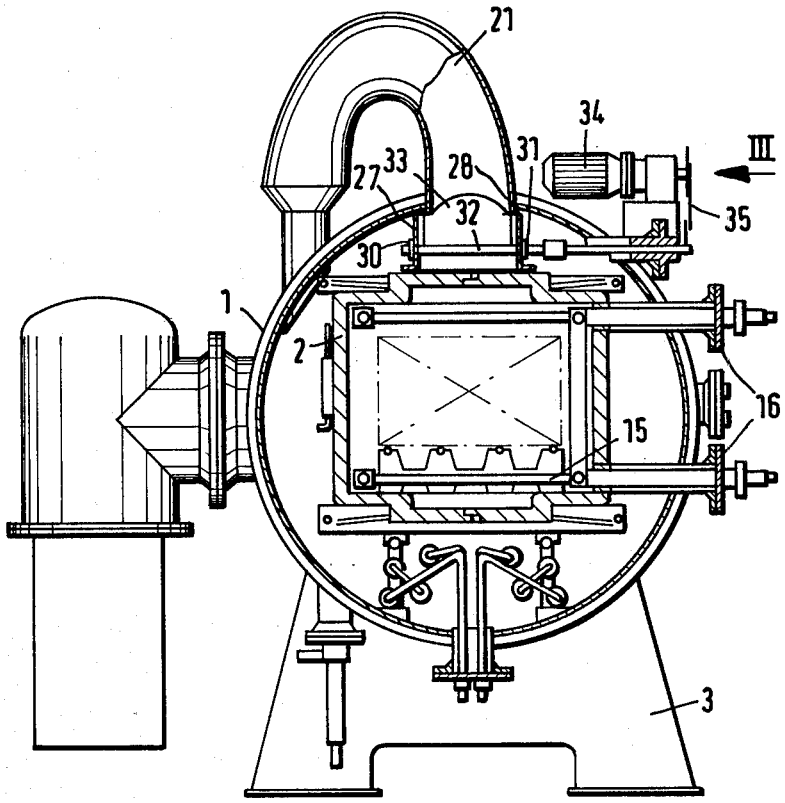
FIG. 2 is a cross section through the furnace of FIG. 1 along the line II—II of FIG. 1.

Within the heating chamber 2, electric heating elements 15 are provided above and below the charge, they assuring a rapid heating of the charge to the treatment temperature and a high uniformity of the temperature. The feeding of the current to the heating elements 15 through the furnace housing 1 and the shell of the heating chamber can be noted from FIG. 2 of the drawing. The entire apparatus is designated by the reference number 16 and it will not be further described here since it is of conventional type.

Within the furnace housing 1, behind the heating chamber 2, there is a heat exchanger 17 having a plurality of cooling coils to which water is fed via feed lines 18 and discharged via discharge lines 19. The heat exchanger 17 serves for the rapid cooling of the quenching gas which has been heated by the hot workpieces.

The quenching gas is circulated by a heavy-duty blower 20 which is arranged along the same axis as and behind the heat exchanger 17 within the furnace housing 1. The blower 20 has a central gas intake connection 37 on the side thereof facing the heat exchanger 17 and a tangential outlet (not visible in the drawing) which extends as a pressure outlet connection out of the furnace housing 1 and is connected by a pipe 21 with a sheet metal hood 22 which is placed on the heating chamber 6 within the furnace housing 1.

The blower 20 is driven by a motor 23 which is arranged coaxially within the hood 5 which extends the furnace housing 1 on the end side towards its rear. The electric terminals of the motor are shown diagrammatically in FIG. 1 of the drawing designated by the reference number 24.

The sheet metal hood 22 is of a funnel shape and is fastened upside-down, i.e. with the wider funnel opening towards the bottom and the narrower pipe end towards the top, on the heating chamber above the closing slide 9. The sheet metal hood 22 has front and rear walls 25, 26 which extend outward from the vertical at an angle of about 45° as well as vertically extending transverse walls 27, 28 (see FIG. 2 of the drawing). The sheet metal hood 22 is open at the bottom towards the closing slide 9 and is developed towards its top as a pipe socket 29 to which the pipe 21 is connected. The transverse walls 27, 28 of the sheet metal hood 22 are provided with bearings 30, 31 for a transversely extending shaft 32 to which a flap 33 is fastened. The transition from the funnel-shaped part of the sheet metal hood 22 to the pipe socket 29 forms on each side a front and resting rear abutment surface for the substantially rectangular flap 33 in its respective end positions.

The shaft 32 is arranged centrally within the sheet metal hood in such a manner that in each of its end positions the flap 33 forms approximately an angle of 45° with the vertical. The surface of the flap thus corresponds to the opposite front and rear walls respectively of the sheet metal hood 22 and, together with the corresponding parts of the transverse walls 27 and 28, forms an obliquely extending shaft which deflects the stream of gas from the pipe 21 upon its passage into the heating chamber.

Figure 3:
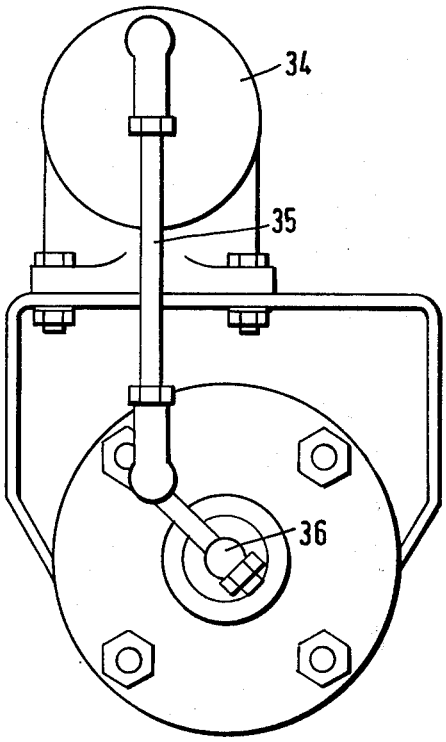
FIG. 3 is a top view of a flap-actuating system seen in the direction of the arrow III in FIG. 2.

The swingable flap thus guides the incoming stream of gas within the region of the free cross section of the chamber opening when the closing slide 9 opens the latter. The swinging of the flap 33 is effected via the motor drive shown in FIG. 3 of the drawing comprising a motor 34, an articulated line 35, and an intermediate shaft 36 which is connected to the shaft 32. As a result of the design of the transmission the flap can swing 90° and back.

It may be pointed out that, differing from the embodiment shown, it is also possible to use a parallelogram flap with multiple flap leaves and, in place of the bottom flap mounting with upward extending flap shown in the example, it is also possible to provide a top flap mounting with a downwardly hanging flap.

The single-chamber vacuum furnace with pressure-gas quenching device which has been described as example above, is filled with the charge through the opened front door 4 and the downwardly swung heating-chamber door 12. The charge rests within a charge basket on the charge table 13. The heating chamber door 12 and the front door 4 are closed, in order, for instance, to carry out a hardening. Similarly, the closing slides 8 and 9 of the heating chamber 2 are closed. The vacuum pump system is now turned on and the heating chamber 2 is evacuated to $10^{-3}$ mbar. By the turning on of the heating, temperatures of up to more than 1300° C. are established in the heating chamber 2 by means of the heating elements 15. Different temperature programs can be employed, as required.

After the desired operating temperature has been held for a predetermined period of time, the heating chamber 2 if flooded, for quenching with neutral gas until the establishing of a pressure of maximum 5 bar gauge. At the same time the blower 20 is turned on and the closure slides 8 and 9 are opened. The quenching gas is circulated by the blower 20 with a high velocity of flow and cools the charge by removal of heat. The quenching gas flows, in this connection, out of the pressure outlet connection of the blower 20 via the pipe 21 into the sheet-metal hood 22, in which it is deflected onto the charge in a manner described further below. The quenching gas flows through the charge and leaves the heating chamber through the bottom opening at the level of the closure slide 8, which slide is open. The cooling of the gas takes place within the heat exchanger 17, which it leaves centrally and is then again drawn-in by the blower 20 through the gas intake connection.

During the quenching process the flap 33 is swung back and forth in order to deflect the quenching gas over the entire charge. For this purpose, the motor 34 is turned on and as a result of the movement of the shaft 32 produced thereby the flap 33 carries out a continuous backward and forward movement over an included angle of 90°. By the deflecting of the stream of gas to the left and right from the vertical, the entire surface of the charge can be moved over by the quenching gas and thus the furnace space available within the heating chamber 2 can be fully utilized. A very rapid and extremely uniform cooling is obtained. The course of the treatment is controlled entirely automatically.

We claim:

1. An industrial furnace, particularly a single-chamber vacuum furnace, for heat treatment of metallic workpieces, comprising a furnace housing formed with a heating chamber inside said furnace housing, means comprising heating elements for heating said heating chamber, a bottom and a top of said heating chamber is formed with a closable chamber opening directly exposed to said heating chamber for the passage of a quenching gas, means including a blower and connections for circulating the gas substantially vertically downwardly through said chamber opening and said heating chamber, said chamber opening in said top being a gas entrance chamber opening for the incoming flow of gas, a closing slide disposed above the gas entrance chamber opening and constituting means for closing said gas entrance chamber opening, means comprising a flap swingably mounted adjacent the gas entrance chamber opening, said flap means for cooperating with said gas entrance opening to alternately open and close different cross-sections thereof for controlling the incoming flow of gas in the vicinity of an exposed cross-section of the gas entrance chamber opening.

2. The industrial furnace according to claim 1, wherein said flap is mounted in the path of the flow of the gas directly in front of the gas entrance chamber opening.

3. The industrial furnace according to claim 1, wherein said flap defines a pivot axis, said gas entrance chamber opening defines a cross sectional plane, said pivot axis of the flap extends parallel to the cross sectional plane of the gas entrance chamber opening.

4. The industrial furnace according to claim 1, wherein said flap defines a pivot axis, said pivot axis runs centrally relative to the gas entrance chamber opening.

5. The industrial furnace according to claim 1, wherein said flap has at least one end position in which position it covers off closing one region of the exposed cross section of the gas entrance chamber opening.

6. The industrial furnace according to claim 5, wherein said gas entrance chamber opening defines a cross sectional plane, in said end position said flap forms an angle of about 45° with the cross sectional plane of the gas entrance chamber opening.

7. The industrial furnace according to claim 1, wherein said flap is formed as a multiple flap in parallelogram arrangement.

8. The industrial furnace according to claim 1, wherein said flap has end positions of a swinging movement thereof, said flap is disposed such that a swinging movement of the flap from one of said end positions to the other of said end positions takes place against the flow of the gas.

9. The industrial furnace according to claim 1, wherein the blower has a pressure outlet connection, the latter constituting one of said connections, said flap defines end positions of a swinging movement thereof, a sheet metal hood defines upper and lower openings, said hood substantially encircles said gas entrance chamber opening, said hood has limit surfaces constituting abutment surfaces, said flap is pivotally mounted in said hood and in said end positions abuts said abutment surfaces of said hood, and a tube is connected with said pressure outlet connection of the blower and with the hood at said upper opening, said tube and said hood constitute other of said connections.

10. The industrial furnace according to claim 9, wherein said hood widens funnel-shaped from said upper opening to said lower opening toward the gas entrance chamber opening and has funnel surfaces which form said abutment surfaces for said flap, said funnel surfaces are at an angle of 45° relative to a vertical axis of the furnace.

11. The industrial furnace according to claim 1, wherein the blower is a heavy duty blower and has a pressure inlet connection and a pressure outlet connection, means comprising a heat exchanger disposed inside of said furnace housing for cooling the gases exiting from the chamber opening in the bottom of the heating chamber, said heat exchanger and the blower are arranged behind the heating chamber inside of said furnace housing and said blower is arranged in back of said heat exchanger, said heat exchanger is disposed upstream of said pressure inlet connection of said blower, a tube disposed outside of said furnace housing between said pressure outlet connection of the blower and the gas entrance chamber opening to the heating chamber, said pressure inlet connection, said pressure outlet connection and said tube constitute said first-mentioned connections.

12. The industrial furnace according to claim 11, further comprising a hood is flanged on the furnace housing on an end thereof, a blower motor operatively connected to the blower is housed in said hood.

* * * * *